US005591087A

United States Patent [19]

Salinas

[11] Patent Number: 5,591,087

[45] Date of Patent: Jan. 7, 1997

[54] POOL TABLE

[76] Inventor: Lee G. Salinas, 2210 Fawn Mist La., San Antonio, Tex. 78248

[21] Appl. No.: 192,834

[22] Filed: Feb. 7, 1994

[51] Int. Cl.[6] ..... A63D 15/00

[52] U.S. Cl. ..... 473/3

[58] Field of Search ..... 473/3, 31, 32, 473/87 B, 30

[56] References Cited

U.S. PATENT DOCUMENTS

| | | | |
|---|---|---|---|
| 1,979,177 | 10/1934 | Staff | 473/3 |
| 2,014,788 | 9/1935 | Strickler | 473/3 |
| 3,138,387 | 6/1964 | Michel | 473/3 |
| 3,578,321 | 5/1971 | Skully | 473/3 |
| 3,941,973 | 1/1976 | Moe | 273/87 B |
| 4,579,342 | 4/1986 | Mortensen | 473/3 |
| 4,875,680 | 10/1989 | Gross | 273/87 B |

*Primary Examiner*—Theatrice Brown
*Attorney, Agent, or Firm*—David G. Henry

[57] ABSTRACT

Applicant's invention includes an apparatus for playing a game. Applicant's apparatus includes an assembly of ball ports and rails which, when assembled and laid on a floor or ground surface, resembles a billiard table. A mat of indoor/outdoor carpet underlies the space defined by the assembly of rails and ball ports. Golf balls are used in similar fashion to billiard balls, with a golf putter being used to put the balls into play. The game can be played using Applicant's apparatus either indoors or outdoors, anywhere where a fairly flat and level surface can accommodate the assembled apparatus.

3 Claims, 2 Drawing Sheets

POOL TABLE

BACKGROUND OF THE INVENTION

1. Field of the Invention

Applicant's invention relates to game and recreational devices involving balls, golf clubs, and/or billiard table-like playing platforms.

2. Background Information

The amateur game and recreational equipment field is a multi-billion dollar industry in the United States. Games which involve multiple parties, are suitable for players of widely ranging age, agility, and sports skill enjoy particularly prolonged favor with the public. Croquet provides a classic example of one such game. Nevertheless, there seems to always be room for new additions to the group of games which are susceptible to wide appeal.

Particularly in light of today's heightened interest in certain sectors in fostering and preserving high-quality family environments, particularly for children, games which families can and are likely to play together in their yards or at nearby parks are particularly welcome additions to our marketplace. Especially if a new family game is one which involves active, physical involvement, rather than purely passive, verbal play, such games provide a welcome alternative to video games which tend to haunt many parents who are concerned about their childrens' development into introverted, passive "couch potatoes."

Another "virtue" of a desirable new family game is that of involving familiar and/or easily acquired skills. For example, a game which involves the rules, equipment, and/or physical action of previously-existing game(s), yet represents an improvement over those games in some respect, is one which is more likely to be tried, as compared with a game which involves complicated rules and/or difficult physical maneuvers.

SUMMARY OF THE INVENTION

It is an object of the present invention to provide a novel and unobvious apparatus useful for playing a game.

It is another object of the present invention to provide a novel and unobvious apparatus useful for playing a single or multi-player game.

It is another object of the present invention to provide a novel and unobvious apparatus useful for playing a game, which game involves and fosters hand-eye coordination.

It is another object of the present invention to provide a novel and unobvious apparatus useful for playing a game, which apparatus combines skills involved in playing two previously unrelated, but commonly known games.

It is yet another object of the present invention to provide a novel and unobvious apparatus useful for playing a game which can be played and enjoyed by persons of widely varying game skills, physical dexterity, etc.

It is another object of the present invention to provide a novel and unobvious method for playing a game, which method combines skills involved in playing golf and billiards.

It is yet another object of the present invention to provide a novel and unobvious method for playing a game, which method involves the use of golf clubs, a ground-level pool table-like apparatus, and golf balls to play a game similar to billiards.

Applicant's invention provides a gound-level billiard table-like apparatus for use in playing a novel game which combines the putting skill of golf and the game objectives of billiards.

DETAILED DESCRIPTION OF THE PREFERRED EMBODIMENT

Figure 1:
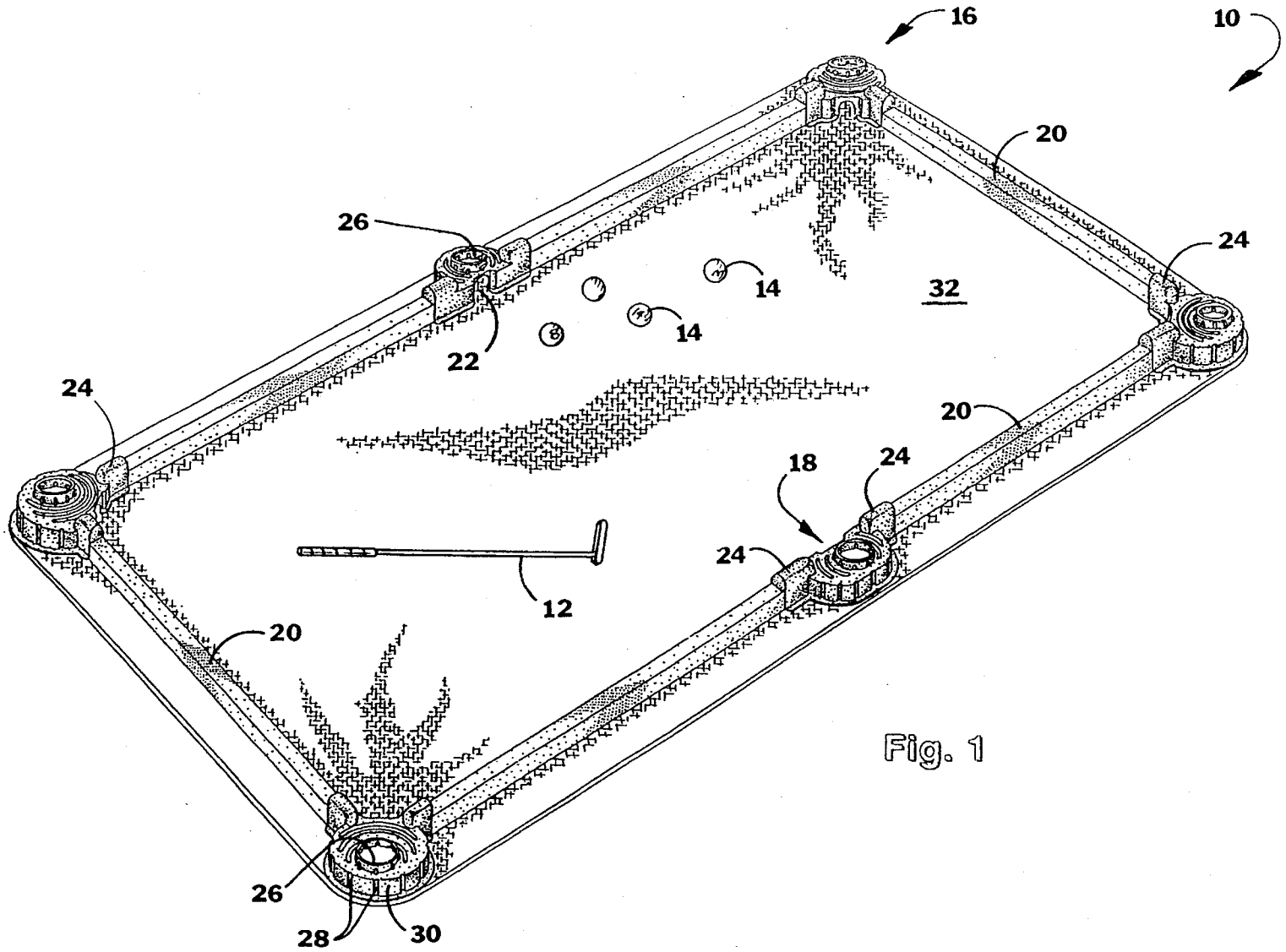
FIG. 1 is a perspective view of the preferred embodiment of the "table" portion of Applicant's game apparatus.
Figure 2:
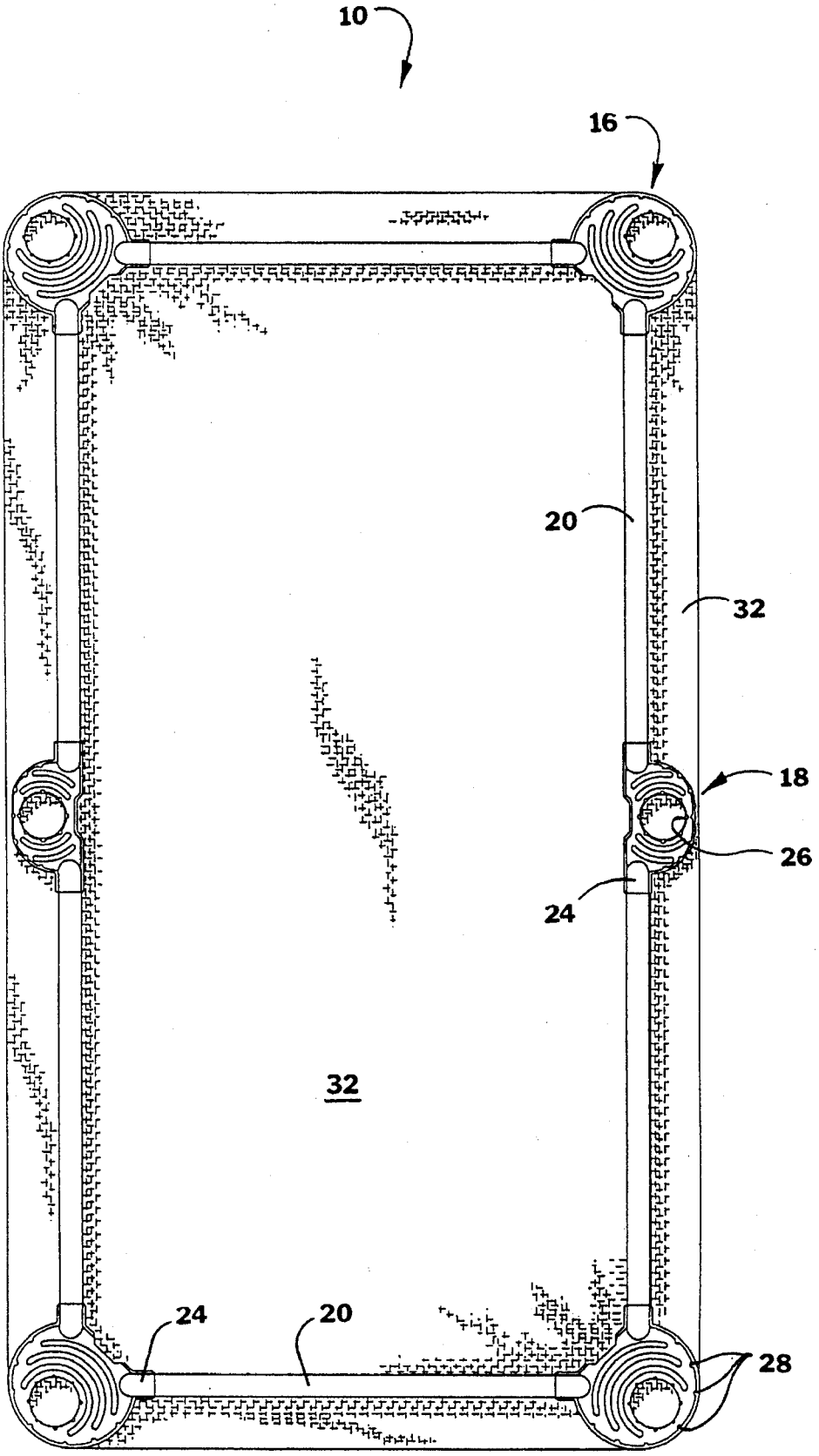
FIG. 2 is a top plan view of the "table" of FIG. 1.

Referring to FIG. 1, the principle component of Applicant's game apparatus is a "table" which is referenced by the numeral 10. "Table" 10 is not actually a table at all, but is a ground or floor level platform upon which Applicant's gaming method is played. Table 10 is called a "table" simply because it obviously resembles a billiards table.

Applicant's game is played using golf putting clubs 12 and golf balls 14. Golf balls 14 are colored and numbered in the same manner as billiard balls. The color and graphics on the preferred embodiment of golf balls 14 are impregnated into the skin of each ball, rather than painted. Any painted surface on the golf balls 14 will chip through normal use. Golf balls of the preferred embodiment have been manufactured by the Best Golf Balls company of Genoa, Ill. 60135. It is envisioned that virtually any billiards game can be adapted for play using Applicant's table 10 with the respective rules being essentially unchanged.

Table 10 comprises four corner ball ports 16 and two side ball ports 18. The ball ports 16 and 18 of the preferred embodiment are formed of high density polyethylene plastic. The ball ports 16 and 18 of the preferred embodiments were vacuum formed.

Each ball port 16 and 18 interface with two rails 20. Rails 20 are, in the preferred embodiment, formed from forty-three inch sections of two and one-half inch square, hollow, PVC down spout conduits such as is available from hardware outlets.

Numerous other materials, dimensions and configurations were attempted for rails 20, with only the PVC down-spout sections providing superior re-bounding and ball management characteristics. Solid rails, for example, lacked the resiliency to re-bound the balls properly, and were too weighty for economical shipment and easy assembly and transport by an owner. Taller rails were too obstructive to players, while shorter rails too easily allowed balls to "hop" the rail during normal play.

Each ball port 16 and 18 includes a ball trap portal 22 through which balls 14 pass during play into the hollow interior of each ball port 16 and 18. Also formed into the body of ball ports 16 and 18 are two rail receptacles 24, each sized and shaped to telescopically and snugly receive an end of a rail 20. To insure stability of the ball port 16/18 and rail 20 assembly, rail receptacles 24 should be configured so as to snugly receive at least three inches in length of each rail 20. However, the fit between rails 20 and the rail receptacles 24 should not be so tight as to prevent easy disassembly by users.

A central retrieval port 26 is formed in the top of each ball port 16 and 18 and is intended for users to retrieve balls 14 after each round of play. Both for safety and aesthetic purposes, all surface margins of ball ports 16 and 18 are radiused as shown in the drawings.

Inwardly projecting ridges 28 are formed about the periphery of side walls 30 of each ball port 16 and 18. Ridges 28 serve two purposes: (1) they strengthen the ball ports 16 and 18 as against crushing (as when a player might accidentally step upon one); and (more importantly) (2) they tend to divert the direction of the rebounding ball 14 such that the ball 14 remains in the ball port 16 or 18 rather than bouncing back onto the playing surface.

The corollary to the felt of a billiards table, in Applicant's preferred embodiment of his table 10, is a five feet by ten feet (5'×10') mat 32 which is cut from indoor/outdoor carpet. Mat 32 is, in the preferred embodiment, formed from such carpet as one would expect to see, for example, at a PUTT PUTT miniature golf course.

In certain embodiments of applicants table 10, small cleats (not shown in the drawings) are formed on the lower margins of the ball ports 16 and 18 so as to engage the mat 32 and prevent slippage of the ball port/rail assembly during normal use.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A pool table apparatus comprising:

a plurality of rails each having first and second rail ends, said rails are substantially linear, elongate plastic members of defining an interior face, and exterior face, an upper face and a lower face, said interior face and said exterior face defining spatially separate, but parallel first and second planes, and said upper face and said lower face defining spatially separate, but parallel third and fourth planes;

a plurality of ball ports, each said ball port comprising a side wall and a top section, each said side structure defining a substantially circular interior wall surface and a ball trap orifice and, on either side of said ball trap orifice, defining first and second rail connection means for respectively, connecting said ball port with a first rail end of one of said rails, and with a second rail, said first and second connection means being sized and shaped for telescopic mating with said first and second rails, said side wall further defining ridges which project into interior space defined by said side structure within said ball ports, said ridges being oriented substantially perpendicular to the long axis of said rails when said apparatus is assembled and with a ground plane defined by a surface upon which said apparatus is assembled;

said rails and said ball ports being connected in such a manner to define a playing space perimeter;

a mat member, said mat member being constructed of indoor/outdoor carpet and sized and shaped to occupy a space substantially coextensive with said playing space as defined on a surface jointly by said ball ports and said rails;

a golf club; and a plurality of playing balls, each said playing ball respectively bearing indicia corresponding to indicia of each ball in a standard set of billiard balls.

2. The invention of claim 1 wherein there are at least four ball ports situated at corners of a four-sided playing space.

3. The invention of claim 1 wherein there are at least six ball ports, four of said ball ports being situated at corners of a rectangular space, and one of said ball ports being situated respectively at substantial mid-points of first and second long-sides of said rectangular playing space, said compliment of rails comprising six rails, one rail extending between and being connected to adjacent ball ports.

* * * * *